United States Patent [19]

Sjödin

[11] Patent Number: 4,563,964

[45] Date of Patent: Jan. 14, 1986

[54] SEWING MACHINE DRIVE CONTROL

[75] Inventor: Gunnar O. M. Sjödin, Lekeryd, Sweden

[73] Assignee: Husqvarna Aktiebolag, Sweden

[21] Appl. No.: 453,886

[22] PCT Filed: Apr. 5, 1982

[86] PCT No.: PCT/SE82/00106

§ 371 Date: Dec. 20, 1982

§ 102(e) Date: Dec. 20, 1982

[87] PCT Pub. No.: WO82/03879

PCT Pub. Date: Nov. 11, 1982

[30] Foreign Application Priority Data

Apr. 30, 1981 [SE] Sweden ..... 8102758

[51] Int. Cl.[4] ..... D05B 69/26

[52] U.S. Cl. ..... 112/275

[58] Field of Search ..... 112/275, 277, 220, 121.11, 112/67, 87

[56] References Cited

U.S. PATENT DOCUMENTS 3,636,902 1/1972 Matsubara et al.* ..... 112/275

4,262,614 4/1981 Sugaya et al. ..... 112/275 X

*Primary Examiner*—Peter Nerbun

*Attorney, Agent, or Firm*—Alfred E. Miller

[57] ABSTRACT

A driving control device for an electronic sewing machine has a computer and an automatic needle stop system. The needle stopping arrangement is responsive to operation of the foot control regulator, and is arranged to stop the needle in its upper position in response to a first raising of the regulator, and is responsive to a second raising of the regulator within a half cycle of the machine operation for stopping the needle at its lowermost position.

6 Claims, 1 Drawing Figure

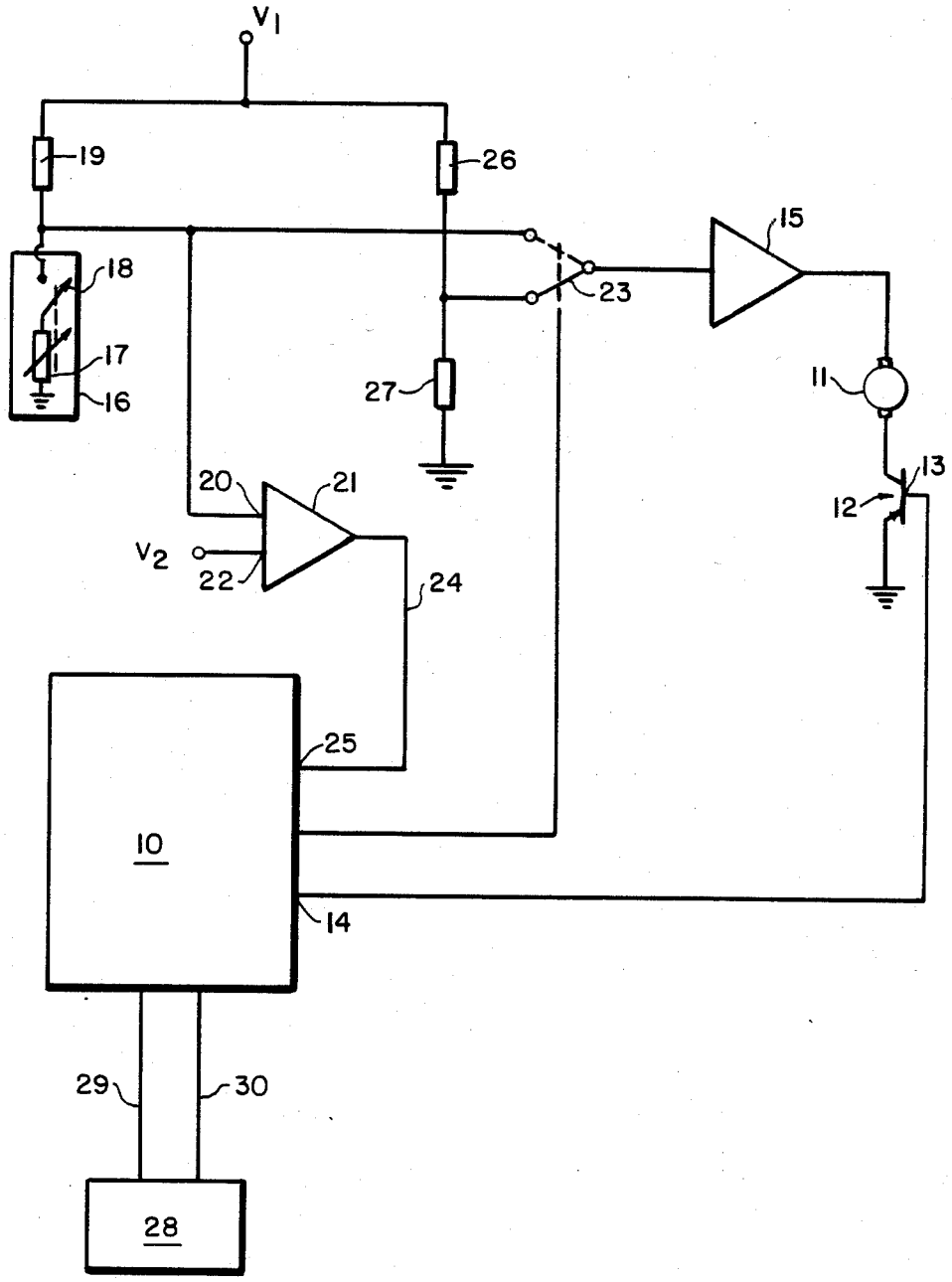
V1
19
26
15
18
23
17
16
27
11
13
12
20
21
V2
22
24
25
10
14
29
30
28

SEWING MACHINE DRIVE CONTROL

This invention relates to a driving control device for a domestic, electronic sewing machine.

In modern sewing machines with data circuits, arrangements are provided in the electronic system in order to stop the machine when the needle comes to its upper end position. Due to this arrangement to stop the machine in a predetermined needle position, the work piece can be taken out of the machine or positioned in the same without any further adjustment on the machine. A similar advantage can be achieved by a completion of the arrangement with an alternative stop position of the needle at the lower end position thereof. The needle can then be used as a pivot when the operator wants to swing the cloth around the needle through a certain angle. An arrangement such as this will also offer an advantage in a so-called single stitch operation, darning and tacking, as the operator then has time to watch every stitch and to plan for the next one.

The present invention provides a solution to the problem of positioning the needle in a desired position (up or down) by means of the current regulator of the machine. In accordance with the invention a needle stop automatic system of the machine is provided by which not only the stopping of the needle in predetermined positions is achieved when the current from the regulator is switched off but also the positioning thereof in desired end positions (up or down) by the use of short pulses from the regulator. Since the regulator is actuated by a foot in conventional manner, the operator has both her hands free for handling the work piece.

An example of an embodiment of a driving control device according to the invention will now be described with reference to the attached drawing which shows a wiring diagram of the device.

In an electronic sewing machine with a computer 10, the driving motor 11 of the machine is controlled by a control circuit comprising a transistor 12 with a base electrode 13 supplied with a control current from the output 14 of the computer. An amplifier 15 supplies the motor in dependence on a second control circuit comprising a regulator, e.g. a foot pedal 16 adjusting a potentiometer 17 which changes its resistance in dependence of the position of the pedal. A switch 18 in series with the potentiometer is actuated for breaking the circuit when the pedal is in its upper end position. The control circuit is supplied with a low voltage $V_1$ which passes via a resistor 19 to a change-over switch 23 and also to the input 20 of a comparator 21 having a second input 22 supplied with another low voltage $V_2$ somewhat lower than the first said voltage. When the foot regulator is pressed down the voltage on the input 20 decreases and is less than the voltage $V_2$, whereby a signal in the form of a logical "0" or "1" passes via a wire 24 to the input 25 of the computer. In the computer there is a logic circuit which on occurence of a "0" on the wire 24 supplies a control current via the wire 14 to the transistor so that the motor 11 can start by means of the foot regulator and the change-over switch 23 in the shown dash-line position.

On return of the regulator to the upper position the logical signal is "1", and the computer makes by controlling the change-over switch a change of the position of the switch to that shown by continuous lines. The voltage $V_1$ provides via a voltage divider 26,27 a control voltage effecting a low, constant r.p.m. of the motor, and the machine runs slowly whereby a sensor 28 at the arm shaft of the machine detects the end positions of the needle. On a couple of wires 29, 30 from the sensor the logic circuits in the computer obtain signals when the needle is "up" or "down". When the regulator is returning in the upper position after a period of work, only the logical circuit for "needle up" is connected. The first signal for "needle up" occurring after such a return of the regulator when the machine runs slowly releases, in the computer, a break in the control current to the transistor 12 which makes the motor stop when the needle is "up". Thus, these circuits make the machine stop when the needle is in its upper end position after the operator has finished a seam therewith or makes an interruption in the work.

When the operator after such a stop reactivates the regulator, the logic circuit for "needle down" is automatically switched in and, provided that the regulator after a moment is inactivated, the machine will run slowly and the needle slowly approach its lower end position. In this position a signal is passed from the sensor 28 on the wire 30 to the corresponding circuit releasing, in the computer, a break in the control current to the transistor 12.

In this way the machine will stop with the needle in its lower end position. This will occur only if the regulator is first made inactive when preceding activation of the regulator was more than half a machine cycle earlier the change-over switch 23 remains in the dash-line position, whereby the logic circuits for "needle up" or "needle down" are disconnected. The next time the regulator is made inactive the change-over switch is set on the position shown by continuous lines and the circuit for "needle up" is switched in. As described here before the machine will stop when the needle is "up".

Another property of the above described device is the fact that the machine will stop at both positions of the needle, if the regulator is activated during a time period less than half a machine cycle. Then both the logic circuits are switched in and make individually a break by the transistor 12. Every push on the foot regulator thus effects a driving of the machine through half a cycle. As said in the introduction such a driving manner of the machine has some advantages.

The described diagram of the device shall be considered an example. Variations of the wiring can, of course, be carried out without changing the function essentially. The invention includes variations within the scope of the following claims.

I claim:

1. In an electronic sewing machine having a motor for moving a needle upwardly and downwardly, an operator foot pedal control, and control means for varying the speed of the motor by controlling the current to said motor in response to movement of said operator control, said foot pedal control having an upper position the improvement further comprising position detectors for sensing the upper and lower end positions of said needle, said foot pedal control having a switch operable at said upper position, said control means being responsive to operation of said switch at said upper position for driving said motor at a lower speed and then stopping the motor when the upper position detector indicates the uppermost positioning of said needle, said control means being further responsive to operations of said switch in periods less than one-half of the movement cycle of said needle for moving said needle to the next respective position of said uppermost and lowermost positions, whereby an operator may selectively stop said needle at said uppermost and lowermost positions by movement of said foot pedal control and when the foot pedal is actuated for a period longer than one half of the movement cycle said position detectors are disconnected.

2. The electronic sewing machine of claim 5 wherein said control means comprises a computer, means for signaling the operation of said switch to said computer, said computer comprising means responsive to operation of said switch for controlling said motor independently of said operator control for driving said needle to the uppermost or lowermost position thereof.

3. In a control device for an electronic sewing machine having a motor, a current regulator, an on/off switch, position detectors for sensing the upper and lower end positions, respectively, of the needle of the machine, and motor control circuits connected to be responsive to the off-position of the switch and a signal from the position detectors when the upper end position of the needle is sensed: the improvement wherein the current regulator and the on/off switch are connected to be operated by a common foot pedal having an upper position, said switch being off in said upper position, said motor control circuit comprising logic circuits responsive to successive movement of said foot pedal to its lower position and the consequent turning on of said switch, only within a predeterminded period, for controlling said motor to be driven sequentially to opposite ones of said upper and lower end positions, whereby the position of said needle may be controlled by the movement of said foot pedal.

4. The electronic sewing machine of claim 1 wherein said operator foot pedal control comprises a potentiometer, connected in series with said switch, said switch being open at said upper position, said means for varying comprising a source of said current connected to said foot pedal control, and means responsive to the voltage thereacross for controlling the current applied to said motor.

5. The electronic sewing machine of claim 4 wherein said control means further comprises a computer circuit connected to said foot pedal control and responsive to the voltage across said foot pedal control for inhibiting variation of speed of said motor in response to control of said potentiometer, at said upper position of said needle.

6. The electronic sewing machine of claim 5 wherein said computer further comprises means in response to the opening of said switch at said upper position for applying a current to said motor, and for removing said current from said motor in response to the sensing of a selective one of said end positions by said position detectors.

* * * * *